US008458935B2

(12) United States Patent
Golle

(10) Patent No.: US 8,458,935 B2
(45) Date of Patent: Jun. 11, 2013

(54) METHOD AND APPARATUS FOR ELECTROLUMINESCENT VINYL BILLBOARD SIGN

(75) Inventor: Aaron J. Golle, Shakopee, MN (US)

(73) Assignee: Safe Lites, LLC, Eden Prairie, MN (US)

( * ) Notice: Subject to any disclaimer, the term of this patent is extended or adjusted under 35 U.S.C. 154(b) by 0 days.

(21) Appl. No.: 13/014,258

(22) Filed: Jan. 26, 2011

(65) Prior Publication Data

US 2011/0119974 A1 May 26, 2011

Related U.S. Application Data

(63) Continuation of application No. 12/441,336, filed as application No. PCT/US2007/019936 on Sep. 13, 2007, now Pat. No. 7,886,466.

(60) Provisional application No. 60/825,552, filed on Sep. 13, 2006.

(51) Int. Cl.
*G09F 13/22* (2006.01)

(52) U.S. Cl.
USPC ..... 40/544; 40/591; 40/556; 40/590

(58) Field of Classification Search
USPC ..... 40/544
See application file for complete search history.

(56) References Cited

U.S. PATENT DOCUMENTS

| | | | | |
|---|---|---|---|---|
| 1,803,439 A | | 5/1931 | Rosenstein | |
| 1,974,039 A | | 9/1934 | Bohannon et al. | |
| 2,095,350 A | | 10/1937 | Soule | |
| 2,122,766 A | | 7/1938 | Wiemer | |
| 3,629,906 A | | 12/1971 | Gasser | |
| 5,005,306 A | | 4/1991 | Kinstler | |
| 5,485,145 A | * | 1/1996 | Sniff | 340/815.4 |
| 5,518,561 A | | 5/1996 | Rosa | |
| 5,572,817 A | * | 11/1996 | Chien | 40/544 |

(Continued)

FOREIGN PATENT DOCUMENTS

| | | |
|---|---|---|
| GB | 463196 | 3/1937 |
| WO | WO-01/52225 A1 | 7/2001 |
| WO | WO-2008/033470 A2 | 3/2008 |
| WO | WO-2008/033470 A3 | 3/2008 |

OTHER PUBLICATIONS

U.S. Appl. No. 12/273,000, Non-Final Office Action mailed Feb. 8, 2010, 10 pgs.

(Continued)

*Primary Examiner* — Casandra Davis
(74) *Attorney, Agent, or Firm* — Schwegman Lundberg & Woessner, P.A.

(57) ABSTRACT

An example includes printing a graphic on a vinyl billboard sign and defining a translucent portion of the vinyl billboard sign, disposing adhesive on one of the vinyl billboard sign and a target surface, overlaying the translucent portion of the vinyl billboard sign with at least one planar electroluminescent lamp unit, overlaying the electroluminescent lamp unit with the target surface; attaching a power bus to the at least one planar electroluminescent lamp, connecting the lamp unit to a source of power, wherein the source of power comprises a power source, and the power bus includes a plurality of individual power lines to carry power to the at least one lamp unit and switching the power source to control illumination of the at least one planar electroluminescent lamp unit to shine through the vinyl billboard sign.

13 Claims, 4 Drawing Sheets

U.S. PATENT DOCUMENTS

| | | | |
|---|---|---|---|
| 6,168,115 | B1 | 1/2001 | Abdelkhaleq |
| 6,283,414 | B1 | 9/2001 | Quinones et al. |
| 6,527,607 | B1 | 3/2003 | Huang |
| 6,698,122 | B1 | 3/2004 | Merenlender |
| 7,065,910 | B2 | 6/2006 | Woodruff |
| 7,296,371 | B2 | 11/2007 | Schimanz |
| 7,364,315 | B2 | 4/2008 | Chien |
| 7,406,787 | B2 | 8/2008 | Smith et al. |
| 7,886,466 | B2 | 2/2011 | Golle |
| 2004/0114349 | A1 | 6/2004 | Golle et al. |
| 2006/0207139 | A1 | 9/2006 | Deflin et al. |
| 2009/0211132 | A1 | 8/2009 | Rosa et al. |
| 2009/0249664 | A1 | 10/2009 | Golle |
| 2010/0122479 | A1 | 5/2010 | Golle |

OTHER PUBLICATIONS

U.S. Appl. No. 12/273,000, Response filed Jan. 5, 2011 to Final Office Action mailed Nov. 5, 2010, 7 pgs.

U.S. Appl. No. 12/273,000, Response filed Aug. 6, 2010 to Non Final Office Action mailed Feb. 8, 2010, 7 pgs.

U.S. Appl. No. 12/441,336, Notice of Allowance mailed Aug. 9, 2010, 8 pgs.

U.S. Appl. No. 12/441,336, Non Final Office Action mailed Oct. 6, 2009, 8 pgs.

U.S. Appl. No. 12/441,336, Preliminary Amendment filed Mar. 13, 2009, 6 pgs.

U.S. Appl. No. 12/441,336, Response filed Apr. 6, 2010 to Non Final Office Action mailed Oct. 6, 2009, 9 pgs.

U.S. Appl. No. 12/273,000, Final Office Action mailed Nov. 5, 2010, 6 pgs.

"Application Serial No. PCT/US2007/019936, International Search Report mailed Sep. 22, 2008", 11 pgs.

U.S. Appl. No. 12/273,000, Notice of Allowance mailed Jan. 31, 2011, 7 pgs.

U.S. Appl. No. 12/441,336, 312 Amendment filed Sep. 9, 2010, 10 pgs.

U.S. Appl. No. 12/441,336, Examiner Interview Summary mailed Jan. 18, 2011, 3 pgs.

U.S. Appl. No. 12/441,336, PTO Response to 312 Amendment mailed Nov. 16, 2010, 2 pgs.

* cited by examiner

METHOD AND APPARATUS FOR ELECTROLUMINESCENT VINYL BILLBOARD SIGN

CLAIM OF PRIORITY AND RELATED PATENT APPLICATIONS

This patent application is a continuation of and claims the benefit of priority under 35 U.S.C. §120 to U.S. patent application Ser. No. 12/441,336, filed on Mar. 13, 2009, entitled "METHOD AND APPARATUS FOR WRAPPING TRAIN WITH ADVERTISEMENT INCLUDING ELECTROLUMINESCENT LIGHTING," which is a U.S. National Stage Filing under 35 U.S.C. 371 from International Patent Application Serial No. PCT/US2007/019936, filed Sep. 13, 2007, and published on Mar. 20, 2008, as WO 2008/033470, which claims priority benefit under 35 U.S.C. 119(e) of U.S. Provisional Patent Application Ser. No. 60/825,552, filed Sep. 13, 2006, entitled "METHOD AND APPARATUS FOR WRAPPING TRAIN WITH ADVERTISEMENT INCLUDING ELECTROLUMINESCENT LIGHTING"; which applications and publication are incorporated herein by reference in their entirety and made a part hereof.

TECHNICAL FIELD

The present invention relates to method and apparatus for wrapping a vehicle with a sheet of material carrying an advertisement, such as one or more images and/or text for the advertisement, wherein there are provided electroluminescent portions of the advertisement.

DETAILED DESCRIPTION

Figure 1:
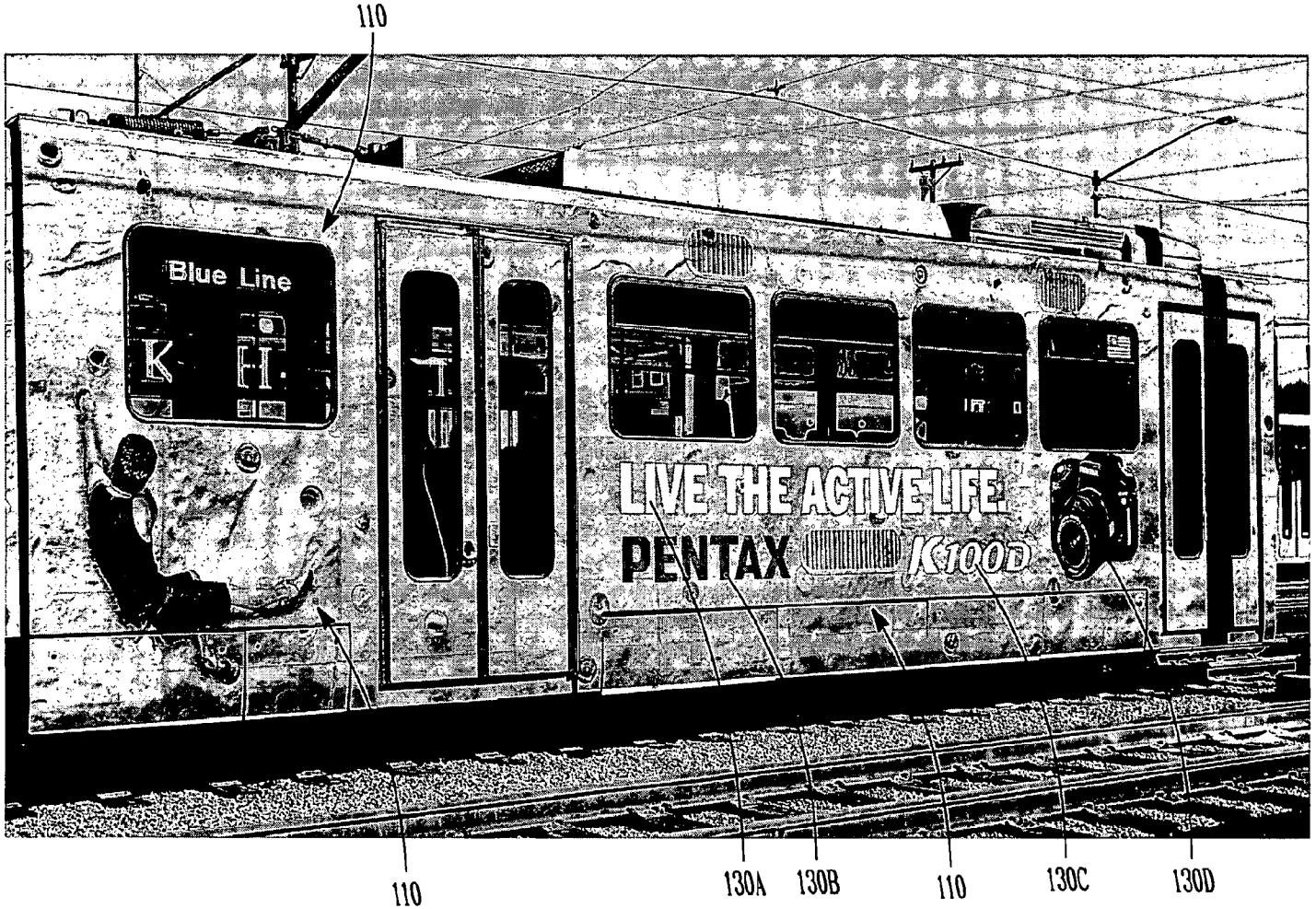
FIG. 1 is a view of an apparatus according to example embodiments of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, electrical changes, etc. may be made without departing from the scope of the present invention.

Figure 2A:
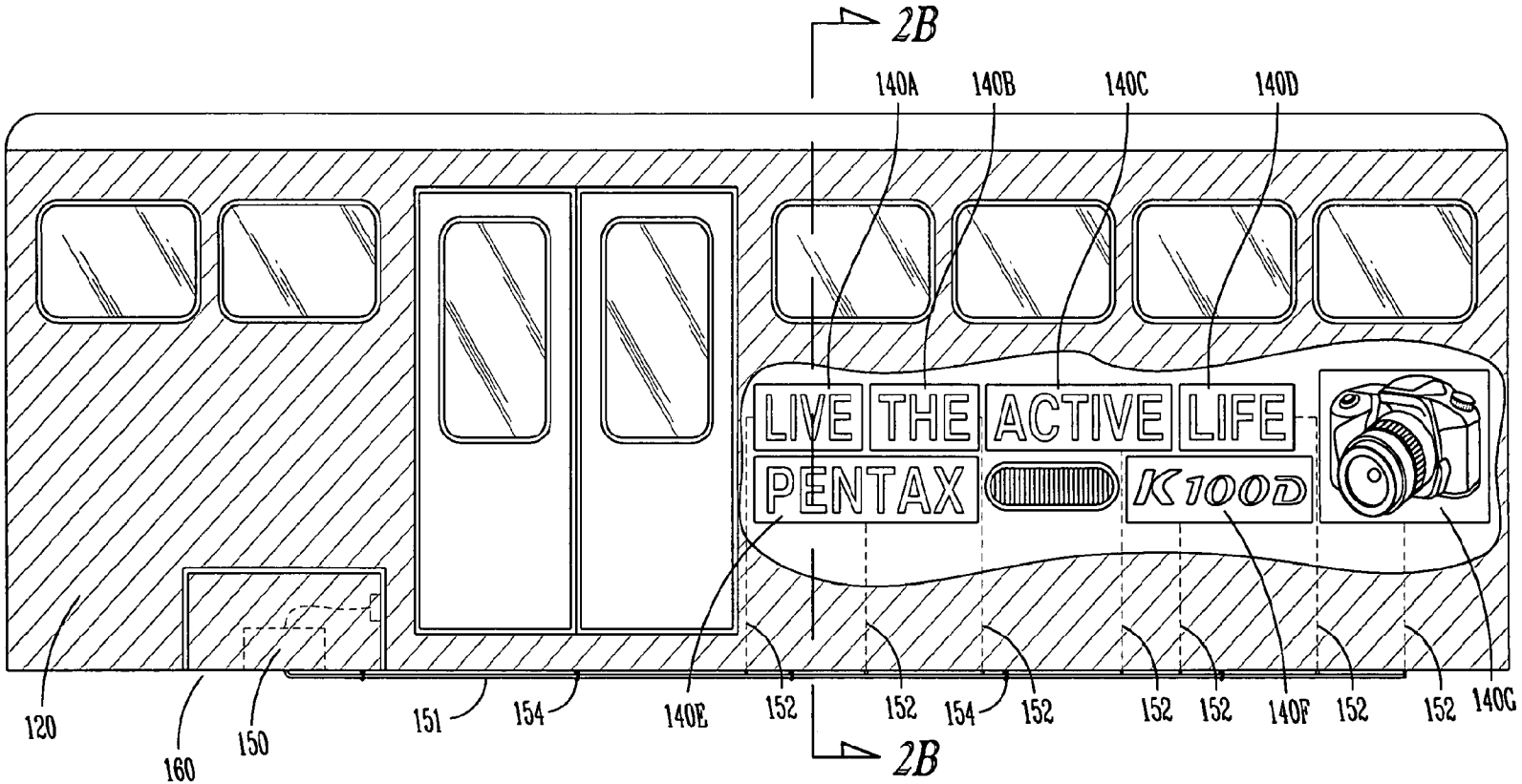
FIG. 2A is a schematic view of an apparatus according to example embodiments of the invention.
Figure 2B:
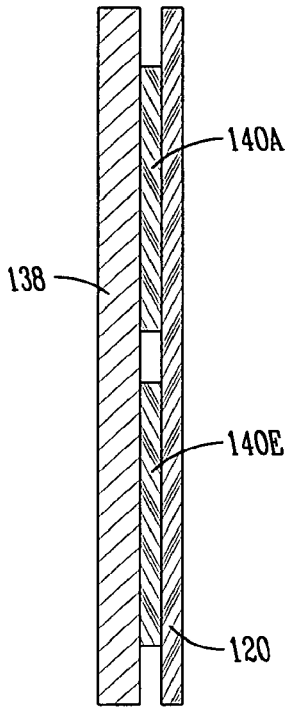
FIG. 2B is a cross sectional taken generally along line 2B-2B of FIG. 2A.

Referring now to FIGS. 1, 2A and 2B there is illustrated a train 100 "wrapped" with advertising indicia 110 carried on a film 120. In the instant example, the advertising indicia 110 is for a camera, and depicts a climbing wall together with the slogan "LIVE THE ACTIVE LIFE" 130*a*, the manufacturer's name PENTAX 130*b*, the name of the camera line or product "K100D" 130*c* and a depiction of the camera 130*d*. In the example, indicia 130*a* to 130*d* are illuminated with planar electroluminescent (EL) lamps that are disposed on the surface of the train under the film 120. According to one embodiment, indicia 130*a* and 130*c* and the white portions of the depiction of camera 130*d* may be illuminated by white or light colored EL lamps, while indicia 130*b* may be illuminated with an EL lamp producing an orange color. According to another example embodiment, the entire depiction of the camera 130*d* may be illuminated by an EL lamp. According to one example embodiment, the orange color or the white colors may be produced by the EL light produced directly by the lamps or by the light produced by the lamp and filtered through a colored transparent overlay, for example but not limited to as shown in U.S. Pat. No. 6,769,138 to Golle, incorporated herein by reference.

Referring to FIGS. 2A and 2B, train 100 is shown with the film 120 cut away exposing EL lamp units 140*a* to 140*g* with in this example embodiment are rectangular, and carry the respective EL illuminated indicia 130*a* to 130*d*. Lamp units 140 are each rectangular, planar lamp assemblies that include planar EL lamps. In one embodiment, the EL lamps are formed in the shape of the alphanumeric characters of indicia 130*a* to 130*d*. In another embodiment, the lamp units 140 are covered with a mask that exposes only the alphanumeric characters of indicia 130*a* to 130*d*, such that the entire surface area of the lamp units 140 produces EL light but only the area exposed the mask is visible.

As illustrated in FIG. 2B, each of the planar lamp units 140*a* to 140*g* are attached to the side 138 of the train 100 using an adhesive or any other suitable attachment. The film 120 (indicated by hashing) is then applied over the side of the train and the lamp units 140*a* to 140*g*, adhering to the side of the train and to the top of the lamp units 140*a* to 140*g*. The film may then be removed from over the indicia 130*a* to 130*d*. so that only the alphanumeric characters or the camera depiction are exposed and the remaining portions of the lamp units 140*a* to 140*g* are covered by the film 120. Alternatively, the alphanumeric characters may be left covered by the film 120 but the film 120 is thin enough or translucent enough to allow the EL illuminated indicia to shine through it or be visible when the illumination is not active.

Figure 3:
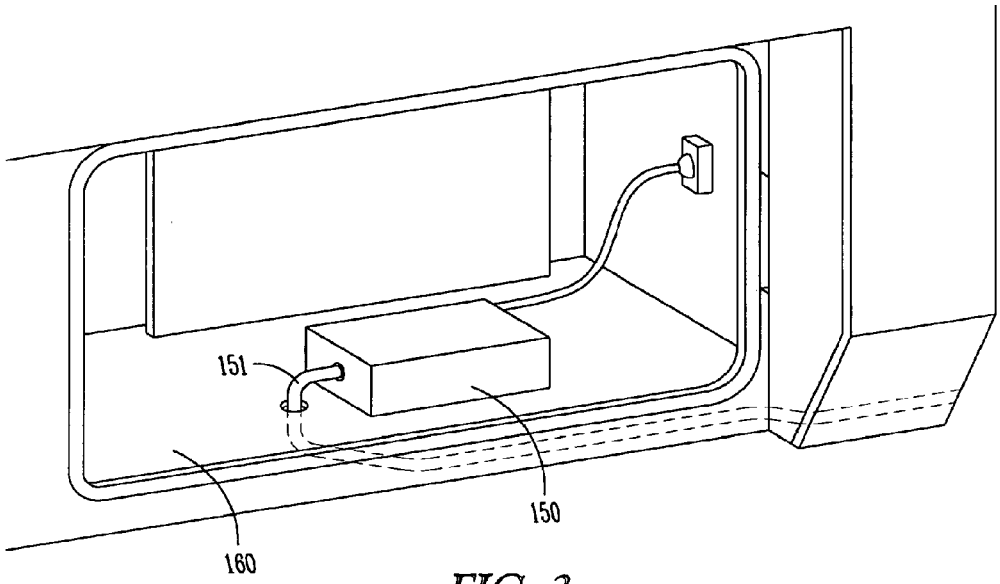
FIG. 3 is a partial view of an apparatus according to example embodiments of the invention

Referring now to FIGS. 2A and 3, the EL lamp units 140*a* to 140*g* are each connected to a source of energy produced by a power and control unit 150. The connection to unit 150 is provided by individual conductors 152 (four for each lamp unit 140*a* to 140*g*, carrying power and ground to, in one embodiment, opposite sides or ends of the lamp units). Conductors 152 may leave unit 150 wrapped as a single bundle 151, and leave the bundle 151 to run to the respective units 140*a* to 140*g*. Accordingly, units 140*a* to 140*g* may each have its own separate power lines. Alternatively, a single bus may be used to run power to each unit 140*a* to 140*g*, although such an arrangement does not allow for controlling the illumination of each unit 140*a* to 140*g* individually.

Power and control unit 150 is housed in a wiring or electrical compartment 160 on the train 100, and is connected to a master power source, such as a 110 volt power supply or any suitable master power supply. Cable bundle 151 runs from the unit 150 through an aperture in the floor of the compartment and to the underside of the train and runs along the side edge on the bottom of the train undercarriage, for example held in place with fasteners 154 that may be attached to any suitable portion of the undercarriage.

Figure 4:
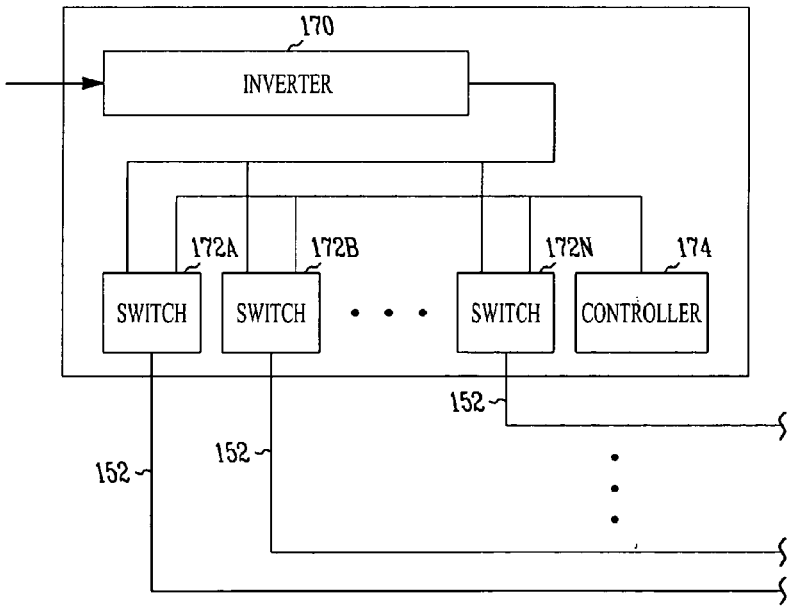
FIG. 4 is a schematic according to example embodiments of the invention

According to still another example embodiment, the power and control unit 150 is shown in more detail in FIG. 4. Unit 150 includes a power inverter 170 that supplies power to conductors 152 through switches 172*a* through 172*n*. Switches 172 are in turn controlled by a computer control device or other controller device 174 that may sequentially activate switches 172*a* through 172*n* and then, for example, activate them all in combination. In another embodiment, each switch may be activated in sequence and left on until all other switches are activated, and leaving all activated for a period of time until all are deactivated. According to another example embodiment, the switches may be deployed remotely from the unit 150, such as on the undercarriage of the train or adjacent the lamp unit 140, and a control line for the switch run from the control unit to the switch.

According to one example embodiment, suitable materials for use as the film 120 include various sheets, preferably comprised of thermoplastic or thermosetting polymeric materials, such as films, providing a substrate to carry the advertising indicia 110, in this example an advertisement for a camera. Further, such films may, in one example embodiment, be low surface energy substrates. "Low surface energy" refers to materials having a surface tension of less than about 50 dynes/cm (also equivalent to 50 milliNewtons/meter). The polymeric substrates are typically nonporous. However, microporous, apertured, as well as materials further comprising water-absorbing particles such as silica and/or superabsorbent polymers, may also be employed provided the substrate does not deteriorate or delaminate upon expose to water and temperature extremes, as previously described. Other suitable substrates include woven and nonwoven fabrics, particularly those comprised of synthetic fibers such as polyester, nylon, and polyolefins. The substrates as well as the imaged article (e.g., sheets, films, polymeric materials) may be clear, translucent, or opaque. Further, the substrate and imaged article may be colorless, comprise a solid color or comprise a pattern of colors. Additionally, the substrate and imaged articles (e.g. films) may be transmissive, reflective, or retroreflective.

Representative examples of polymeric materials (e.g. sheet, films) for use as the substrate 120 include single and multi-layer constructions of acrylic-containing films (e.g. poly(methyl) methacrylate [PMMA]), poly(vinyl chloride)-containing films, (e.g., vinyl, polymeric materialized vinyl, reinforced vinyl, vinyl/acrylic blends), poly(vinyl fluoride) containing films, urethane-containing films, melamine-containing films, polyvinyl butyral-containing films, polyolefin-containing films, polyester-containing films (e.g. polyethylene terephthalate) and polycarbonate-containing films. Further, the substrate may comprise copolymers of such polymeric species. Other particular films for use as the substrate according to the inventive subject matter include multi-layered films having an image reception layer comprising an acid- or acid/acrylate modified ethylene vinyl acetate resin, as disclosed in U.S. Pat. No. 5,721,086 (Emslander et al.). The image reception layer comprises a polymer comprising at least two monoethylenically unsaturated monomeric units, wherein one monomeric unit comprises a substituted alkene where each branch comprises from 0 to about 8 carbon atoms and wherein one other monomeric unit comprises a (meth) acrylic acid ester of a nontertiary alkyl alcohol in which the alkyl group contains from 1 to about 12 carbon atoms and can include heteroatoms in the alkyl chain and in which the alcohol can be linear, branched, or cyclic in nature. A preferred film for increased tear resistance includes multi-layer polyester/copolyester films, such as those described in U.S. Pat. Nos. 5,591,530 and 5,422,189. Depending of the choice of polymeric material and thickness of the substrate, the substrate (e.g., sheets, films) may be rigid or flexible. Preferred primer and ink compositions are preferably at least as flexible as the substrate. "Flexible" refers to the physical property wherein imaged primer layer having a thickness of 50 microns can be creased at 25 C. without any visible cracks in the imaged primer layer.

Commercially available films include a multitude of films typically used for signage and commercial graphic uses, such as available from 3M under the trade designations "Panaflex", "Nomad", "Scotchcal", "Scotchlite", "Controltac", and "Controltac Plus". According to one example embodiment, the train 100 may be wrapped with 3M™ Controltac™ Plus Graphic Film with Comply™ Performance IJ180C-10, printed on roll having, for example, a width of 54 in and a length of 50 yd. This 2 mil, opaque film to produces high quality, long-term graphics with selected piezo ink jet printers. The film 120 may pressure-activated adhesive and 3M Comply™ Performance for easier installation of large fleet graphics, signs, emblems and more. In another embodiment, the film 120 may be 3M Scotchcal™ Luster Overlaminate 8519, 2 mil with PSA, 54 in×300 ft.

Primer compositions and optional barrier compositions applied to substrate 120 are made by mixing together the desired ingredients using any suitable technique. For example, in a one step approach, all of the ingredients are combined and blended, stiffed, milled, or otherwise mixed to form a homogeneous composition. As another alternative, some of the components may be blended together in a first step. Then, in one or more additional steps, the remaining constituents of the component if any, and one or more additives may be incorporated into the composition via blending, milling, or other mixing technique. During the manufacture of the substrate 120, the primer composition may be applied to a surface of the substrate or to the optional barrier layer. The primer may be applied with any suitable coating technique including screen printing, spraying, ink jetting, extrusion-die coating, flexographic printing, offset printing, gravure coating, knife coating, brushing, curtain coating, wire-wound rod coating, bar coating and the like. The primer is typically applied directly to the substrate. Alternatively, the primer may be coated onto a release liner and transfer coated onto the substrate. However, for embodiments wherein the primer surface is exposed and thus is non-tacky, additional bonding layers may be required. After being coated, the solvent-based primer compositions and optional barrier compositions are dried. The coated substrates are preferably dried at room temperature for at least 24 hours. Alternatively the coated substrates may be dried in a heated oven ranging in temperature from about 40° C. to about 70° C. for about 5 to about 20 minutes followed by room temperature drying for about 1 to 3 hours. For embodiments wherein a barrier layer is employed, it is preferred to employ a minimal thickness of primer to minimize the drying time.

The imaged, polymeric sheets may be a finished product or an intermediate and are useful for a variety of articles including signage and commercial graphics films. The commercial graphic films as for example shown in FIG. 1 as substrate 120 may include a variety of advertising, promotional, and corporate identity imaged films. The films typically comprise a pressure sensitive adhesive on the non-viewing surface in order that the films can be adhered to a target surface such as an automobile, truck, airplane, billboard, building, awning, window, floor, etc. Alternatively, imaged films lacking an adhesive are suitable for use as a banner, etc., that may be mechanically attached to building, for example, in order to display. The films in combination with any associated adhesive and/or line range in thickness from about 5 mils (0.127 mm) to as thick as can be accommodate by the printer (e.g. ink jet printer). According to one example embodiment, printing on the films 120 may be done using the Xaar Jet XJ128-200 piezo printhead on an x-y stage at 317 by 295 dpi at room temperature.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. Apparatus comprising:

a large-format billboard target surface;

a large-format one-piece flexible vinyl billboard sign wrapped around the large-format billboard target surface, wherein the large-format one-piece flexible vinyl billboard sign includes a plurality of translucent portions and has printed thereon advertising indicia including opaque advertising indicia, the one-piece flexible vinyl billboard sign being formed of a material adapted to resist delamination when exposed to rainwater;

a plurality of planar electroluminescent lamps disposed under the large-format one-piece flexible vinyl billboard sign and against both the large-format one-piece flexible vinyl billboard sign and the large-format billboard target surface, in alignment with the large-format one-piece flexible vinyl billboard sign so that each can shine through a translucent portion of the plurality of translucent portions, the plurality of planar electroluminescent lamps each including respective lamp connectors to detachably connect to respective ones of a plurality of conductors;

a source of power coupled to the large-format one-piece flexible vinyl billboard sign and adapted to illuminate one or more electroluminescent lamps; and an at least partially bundled power bus including a plurality of conductors to carry power to respective electroluminescent lamps of the plurality of planar electroluminescent lamps, the conductors including respective connectors to allow for detachable connection to an electroluminescent lamp, wherein the source of power is adapted to illuminate the one or more electroluminescent lamps to shine through the translucent portion of the large-format one-piece flexible vinyl billboard sign.

2. Apparatus according to claim 1 wherein the large-format one-piece flexible vinyl billboard sign is selected from a group comprising thermoplastic and thermosetting polymeric materials.

3. Apparatus according to claim 2 wherein the large-format one-piece flexible vinyl billboard sign comprises a low surface energy substrate.

4. Apparatus according to claim 1 wherein at least one of the plurality of planar electroluminescent lamps is shaped to form a component of a depiction shown on the large-format one-piece flexible vinyl billboard sign.

5. Apparatus according to claim 1 wherein the power source includes a control unit including a power inverter and a plurality of switches to selectively connect the power inverter to individual connectors on the power bus.

6. Apparatus according to claim 5 further including a program adapted to sequence the switches to cause the electroluminescent lamps to illuminate in sequence or combination.

7. Apparatus comprising:

a large-format billboard target surface;

a large-format one-piece flexible vinyl billboard sign wrapped around a side of the target surface, the large-format one-piece flexible vinyl billboard sign comprising a translucent portion and an opaque portion, the opaque portion formed of printing disposed on the large-format one-piece flexible vinyl billboard sign;

a plurality of planar electroluminescent lamps disposed under the large-format one-piece flexible vinyl billboard sign and against both the large-format billboard target surface and large-format one-piece flexible vinyl billboard sign, the plurality of planar electroluminescent lamps each including respective connectors to detachably connect to respective ones of a plurality of conductors, wherein each of the plurality of planar electroluminescent lamps are adhered to the target surface;

a source of power coupled to the large-format one-piece flexible vinyl billboard sign and adapted to illuminate one or more of the plurality of planar electroluminescent lamps; and an at least partially bundled power bus including a plurality of conductors to carry power to respective electroluminescent lamps, the conductors including respective connectors to allow for detachable connection to respective connectors of the plurality of planar electroluminescent lamps, wherein the source of power is adapted to illuminate the one or more electroluminescent lamps to shine through the translucent portion of the vinyl billboard sign.

8. The apparatus of claim 7, wherein the source of power is adapted to power the plurality of planar electroluminescent lamps in association with a lighting sequence.

9. The apparatus of claim 8, wherein the source of power is adapted to switch a plurality of switches according to the lighting sequence.

10. The apparatus of claim 7, wherein the large-format one-piece flexible vinyl billboard sign masks at least a portion of the plurality of planar electroluminescent lamps.

11. The apparatus of claim 10, wherein a portion of the large-format one-piece flexible vinyl billboard sign is opaque.

12. The apparatus of claim 11, wherein a portion of the large-format one-piece flexible vinyl billboard sign is clear.

13. An apparatus according to claim 7 wherein at least a portion of the plurality of planar electroluminescent lamps is shaped to form a component of a depiction shown on the large-format one-piece flexible vinyl billboard sign.

* * * * *